US010926534B2

(12) United States Patent
Soleimanzadeh et al.

(10) Patent No.: US 10,926,534 B2
(45) Date of Patent: Feb. 23, 2021

(54) CIRCUIT AND METHOD FOR DETECTING NOZZLE FAILURES IN AN INKJET PRINT HEAD

(71) Applicant: Océ Holding B.V., Venlo (NL)

(72) Inventors: Maryam Soleimanzadeh, Venlo (NL); Catharinus Van Acquoij, Venlo (NL); Amol A. Khalate, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/710,745

(22) Filed: Dec. 11, 2019

(65) Prior Publication Data

US 2020/0189266 A1 Jun. 18, 2020

(30) Foreign Application Priority Data

Dec. 18, 2018 (EP) ..... 18213423

(51) Int. Cl.
*B41J 2/045* (2006.01)

(52) U.S. Cl.
CPC ..... *B41J 2/0451* (2013.01); *B41J 2/04581* (2013.01)

(58) Field of Classification Search
CPC ..... B41J 2/04581; B41J 2/0451
See application file for complete search history.

(56) References Cited

U.S. PATENT DOCUMENTS

2013/0141484 A1 6/2013 Kasai et al.
2013/0257945 A1 10/2013 Shinkawa et al.

FOREIGN PATENT DOCUMENTS

EP 3150380 B1 8/2018
EP 3369575 A1 9/2018
JP 2016-135557 A 7/2016
WO WO 2018/024536 A1 2/2018

OTHER PUBLICATIONS

Search Report issued in European Priority Application 18213423.9, dated May 21, 2019.

*Primary Examiner* — Lamson D Nguyen
(74) *Attorney, Agent, or Firm* — Birch, Stewart, Kolasch & Birch, LLP

(57) ABSTRACT

A method for detecting an operating state of an ejection unit during the printing of an object of a print job the method comprising determining whether the ejection unit is in an operative state or in a malfunctioning state by analyzing a residual pressure wave generated in the liquid in a duct of the ejection unit by an actuation pulse. Further, the method comprises scanning the location of a recording medium onto which liquid has been ejected in order to perform an additional determination of whether the ejection unit is in an operative state or in a malfunctioning state. The method uses both determinations to build feedback information in the form of labeled data that is used in subsequent executions to improve the result of the determinations performed by analyzing a residual pressure wave generated in the liquid. Other aspects of the present invention relate to a droplet ejection device comprising a plurality of ejection units, as well as a printing system comprising the droplet ejection device, and a software product comprising program code on a machine-readable non transitory medium for executing the method in the printing system.

11 Claims, 3 Drawing Sheets

CIRCUIT AND METHOD FOR DETECTING NOZZLE FAILURES IN AN INKJET PRINT HEAD

BACKGROUND OF THE INVENTION

The present invention generally pertains to detecting nozzle failures in an inkjet print head.

It is known to use a piezo-actuator for generating a pressure wave in a pressure chamber of an inkjet print head such that a droplet of liquid, usually ink, is expelled through a nozzle, which nozzle is in fluid communication with the pressure chamber. Further, it is known that the piezo-actuator (or an additional piezo-element or a dedicated part of the piezo-actuator) may be used to detect a pressure wave in the pressure chamber. For example, after actuation, a residual pressure wave remains in the pressure chamber and the residual pressure wave may be detected using the piezo-actuator. Said residual pressure wave is usually analyzed, such that it is possible to infer from it whether the inkjet print head is working correctly. In the case where the inkjet print head is not working correctly, it is possible to infer, with different degrees of reliability, what the cause of the malfunctioning is: presence of an air bubble; presence of dust; too viscous ink, etc. The known methods based on the analysis of residual pressure waves are however incapable of reliable determining the cause of nozzle failures, and may sometimes even lead to a non-negligible amount of both false positives (concluding that a nozzle is failing when it is working correctly) and false negatives (concluding that a nozzle is working correctly when it is not jetting appropriately). Further, the accuracy of the known methods based on analyzing the residual pressure wave often diminishes as the print head ages.

It is also known using an image sensor in order to detect the malfunctioning of an inkjet nozzle, for example side-shooting nozzles. This process was usually only performed during calibration or offline nozzle failure detection. However, it has become possible with the development of suitably faster image sensors to perform low frequency inline image-based nozzle failure detection, which allows printing patterns in a print job (either with very low visibility or in parts to be trimmed out of the printing substrate) in order to perform nozzle failure detection based on those patterns. The known methods based on image sensors show, in comparison, an improved accuracy, but are still significantly slow when compared to those based on analyzing the residual pressure wave.

It is desired to have a method of detecting nozzle failures in a print head that shows appropriate accuracy within reasonable time constraints.

SUMMARY OF THE INVENTION

In an aspect of the present invention, a method of operating a droplet ejection device according to claim 1 is provided. In an aspect of the present invention, a droplet ejection device and a printing system provided.

In another aspect, the present invention comprises a software product comprising program code on a machine-readable non-transitory medium, the program code, when loaded into a control unit of the printing system of the present invention, causes the control unit to perform a method of the present invention.

In an embodiment, the present invention comprises a method for detecting an operating state of an ejection unit during the printing of an object of a print job comprising one or more objects, wherein the ejection unit is arranged to eject droplets of a liquid and comprises a nozzle, in particular a plurality of nozzles; a liquid duct connected to the nozzle; and an electro-mechanical transducer arranged to create an acoustic pressure wave in the liquid in the duct.

In a first step the present invention comprises actuating the electro-mechanical transducer to generate a pressure wave in the liquid. The pressure wave generated in the liquid generates, as is known in the art, a residual pressure wave in the liquid. At least one parameter may be inferred or generated based upon the residual pressure wave that is sensed.

Then, it can be determined by comparing the at least one parameter generated based upon the residual pressure wave with at least one threshold, whether the ejection unit is in an operative state or in a malfunctioning state.

In a next stage, the printing take place by ejecting droplets of liquid from the plurality of nozzles onto the recording medium in accordance with the print job. The ejected droplets should be in accordance with the print job data. Subsequently, an additional check of the operational state the ejection unit to determine whether it is in an operative state or in a malfunctioning state by scanning a location of the recording medium onto which droplets of liquid from the plurality of nozzles have been ejected, thereby providing a scanned image, wherein scanning a location of the recording medium is performed every one or more objects of the print job. Once the scanned image is analyzed it can be determined based on the scanning whether the ejection unit is in an operative state or in a malfunctioning state.

As mentioned before, the accuracy of the determination based on an analysis of parameters determined from a residual pressure wave is smaller than that by scanning the result of the actual ejections. As a consequence, if the determinations of the operative state of the ejection unit determine a different operative state, the operative state is considered to be that determined by scanning the locations of the recording medium onto which liquid has been ejected.

Finally, feedback is provided about the determined state of the ejection unit, which is taken into account the next time a determination about the operative state of the ejection unit is made during the printing of the subsequent objects of the print job. During said printing of the subsequent objects of the print job all the steps explained above are repeated for the following object until the last object of the print job.

In an embodiment, providing feedback about the determined state of the ejection unit by scanning the droplets ejected onto the recording medium comprises storing the at least one parameter generated from the residual pressure wave, and comprises determining during the printing of a second object of a print job that the ejection unit is in the same state determined during the printing of an object of a print job by scanning the droplets ejected onto the recording medium if the at least one parameter measured are similar during the printing of a second object of the print job. This feedback allows improving the determination of the operative state in subsequent iterations of the method during the printing of subsequent objects or even during the printing of subsequent print jobs.

In an embodiment, providing feedback about the determined state of the ejection unit about the determined state of the ejection unit by scanning the droplets ejected onto the recording medium comprises modifying the thresholds to be used when determining the operative state of the ejection unit by analyzing the residual pressure wave during the printing of subsequent objects of a print job.

In an embodiment, the method of the present invention further comprises reducing the number of objects of the print job comprising a plurality of objects for which the scanning a location of the recording medium is performed if both determinations of the operative state of the ejection unit yield the same result during the printing of one or more consecutive objects of the print job.

In an embodiment, the step of determining the operative state of an ejection unit by analyzing parameters of a residual pressure wave further comprises assigning a reliability assessment factor and an ejection failure cause to the determination when it is determined that the ejection unit is in an operative state or in a malfunctioning state.

In an embodiment, the assignation of a reliability factor under a threshold when determining the operative state of an ejection unit by analyzing parameters of a residual pressure wave triggers the scanning a location of the recording medium onto which droplets of liquid from the plurality of nozzles have been ejected during the execution of the method on the same object of the assignation. As an example, the assignation of a reliability assessment factor under a threshold of 0.8 may trigger the scanning during the printing of the object that led to such determination in order to increase the correctness of future determinations.

In another aspect, the present invention comprises a droplet ejection device comprising a number of ejection units arranged to eject droplets of a liquid and each comprising a nozzle, a liquid duct connected to the nozzle, and an electro-mechanical transducer arranged to create an acoustic pressure wave in the liquid in the duct, wherein each of the ejection units is arranged to perform any of the methods of the present invention.

In another aspect, the present invention comprises a printing system comprising the droplet ejection device of the present invention as an ink jet print head.

In another aspect, the present invention comprises a software product comprising program code on a machine-readable non transitory medium, the program code, when loaded into a control unit of a printing system according to the present invention, causes the control unit to execute any of the methods of the present invention.

BRIEF DESCRIPTION OF THE DRAWINGS

The present invention will become more fully understood from the detailed description given below, and the accompanying drawings which are given by way of illustration only, and are thus not limitative of the present invention, and wherein.

DETAILED DESCRIPTION OF EMBODIMENTS

Figure 1:
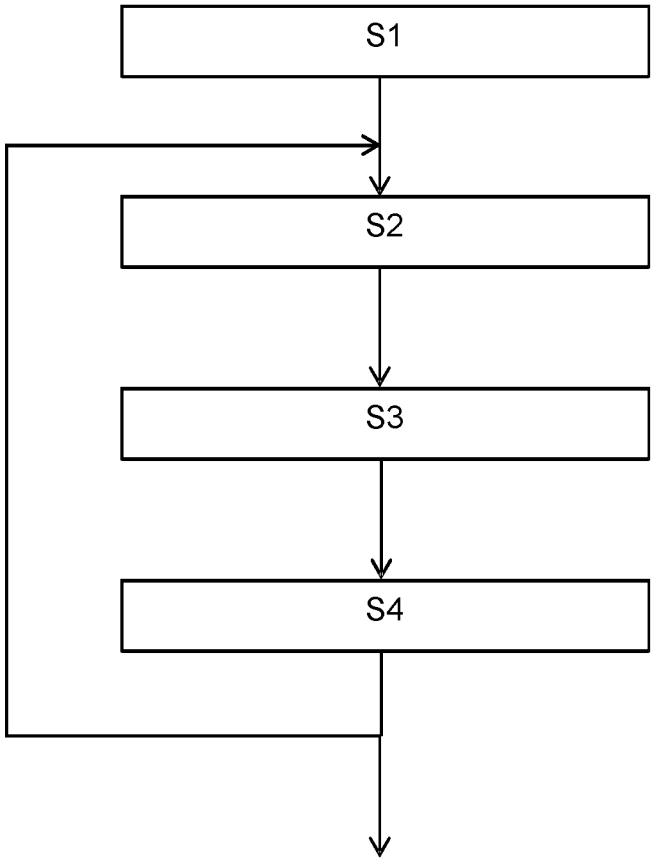
Figure 1 PRIOR ART
FIG. 1 shows a flowchart of a method known in the art of determining the operational state of an ejection unit.

The present invention will now be described with reference to the accompanying drawings, wherein the same or similar elements are identified with the same reference numeral.

As described above, it is known analyzing the residual pressure wave that remains in the pressure chamber of an inkjet print head after an actuation to cause the ejection of a droplet of liquid. This method is fast, which makes it ideal for performing failure detection for every ejection. Further, this method is able to accurately detect many different causes of malfunction, such as the presence of air bubbles, dust, etc. However, this method is not able to accurately identify whenever an ejection unit is ejecting liquid with a deviation significant enough to cause artifacts in the printed image, especially when said shooting deviation is not too high, e.g. between 20 μm and 100 μm.

On the other hand, it is also known using image based sensors to scan the recording medium to identify ejection failures. This method is significantly slower, but is shows a higher accuracy in its determinations. Said accuracy is particularly higher for ejection units shooting with a deviation. As a consequence, this method is mostly used during calibration procedures.

As explained in relation with FIG. 1, it is known using an image based sensor to check the results provided by a detection method based on analyzing the residual pressure waves created by an ejection.

In Step S1 an actuation is made on an ejection unit, thereby causing the ejection of droplets of liquid onto a recording medium. A person skilled in the art would readily understand that this step may take place during the printing of a print job, or during the execution of a calibration procedure.

Subsequently, in step S2, it is determined whether the ejection unit is operating correctly based on an analysis of the residual pressure wave generated by the actuation. Further, it may also be determined what the cause of the malfunction is, in case the ejection unit is not operating correctly.

Next, in step S3 an additional determination is made whether the ejection unit is operating correctly based on scanning the recording medium with an image based sensor or scanner.

In a final step S4 the results provided by steps S2 and S3 are compared with each other and a final determination is made on the operative state of the ejection unit. Subsequently, when the process takes place during the printing of a print job the known methods proceed to repeat the process for the following ejections until the print job is finished.

Figure 2:
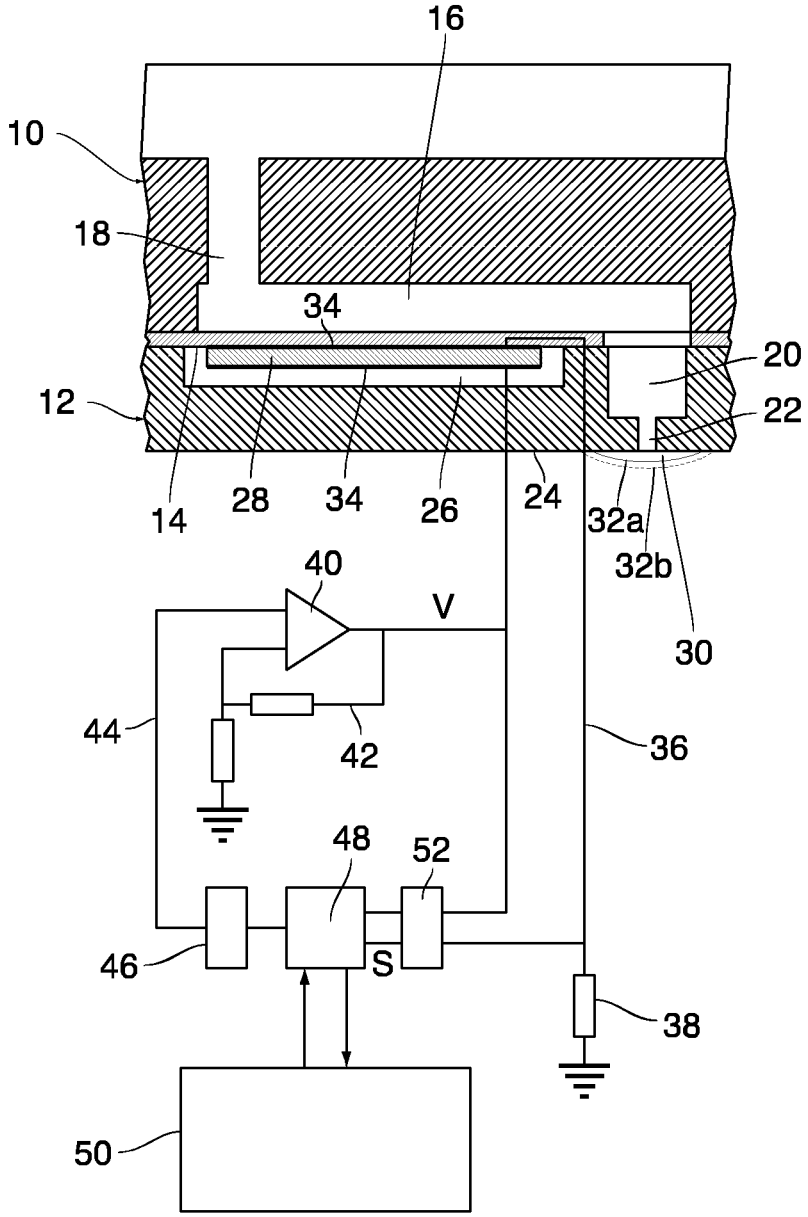
FIG. 2 is a cross-sectional view of mechanical parts of a droplet ejection device according to the invention, together with an electronic circuit for controlling and monitoring the device.

A single ejection unit of an ink jet print head has been shown in FIG. 2. The print head constitutes an example of a droplet ejection device according to the invention. The device comprises a wafer 10 and a support member 12 that are bonded to opposite sides of a thin flexible membrane 14.

A recess that forms an ink duct 16 is formed in the face of the wafer 10 that engages the membrane 14, e.g. the bottom face in FIG. 2. The ink duct 16 has an essentially rectangular shape. An end portion on the left side in FIG. 2 is connected to an ink supply line 18 that passes through the wafer 10 in thickness direction of the wafer and serves for supplying liquid ink to the ink duct 16.

An opposite end of the ink duct 16, on the right side in FIG. 2, is connected, through an opening in the membrane 14, to a chamber 20 that is formed in the support member 12 and opens out into a nozzle 22 that is formed in a nozzle face 24 constituting the bottom face of the support member.

Adjacent to the membrane 14 and separated from the chamber 20, the support member 12 forms another cavity 26 accommodating a piezoelectric actuator 28 that is bonded to the membrane 14.

An ink supply system which has not been shown here keeps the pressure of the liquid ink in the ink duct 16 slightly below the atmospheric pressure, so as to prevent the ink from leaking out through the nozzle 22.

The nozzle face 24 is made of or coated with a material which is wetted by the ink, so that adhesion forces cause a pool 30 of ink to be formed on the nozzle face 24 around the nozzle 22. The pool 30 is delimited on the outward (bottom) side by a meniscus 32*a*.

The piezoelectric transducer 28 has electrodes 34 that are connected to an electronic circuit that has been shown in the lower part of FIG. 2. In the example shown, one electrode of the transducer is grounded via a line 36 and a resistor 38. Another electrode of the transducer is connected to an output of an amplifier 40 that is feedback-controlled via a feedback network 42, so that a voltage V applied to the transducer will be proportional to a signal on an input line 44 of the amplifier. The signal on the input line 44 is generated by a D/A-converter 46 that receives a digital input from a local digital controller 48. The controller 48 is connected to a processor 50.

When an ink droplet is to be expelled from the nozzle 22, the processor 50 sends a command to the controller 48 which outputs a digital signal that causes the D/A-converter 46 and the amplifier 40 to apply an actuation pulse to the transducer 28. This voltage pulse causes the transducer to deform in a bending mode. More specifically, the transducer 28 is caused to flex downward, so that the membrane 14 which is bonded to the transducer 28 will also flex downward, thereby to increase the volume of the ink duct 16. As a consequence, additional ink will be sucked-in via the supply line 18. Then, when the voltage pulse falls off again, the membrane 14 will flex back into the original state, so that a positive acoustic pressure wave is generated in the liquid ink in the duct 16. This pressure wave propagates to the nozzle 22 and causes an ink droplet to be expelled. The pressure wave will then be reflected at the meniscus 32*a* and will oscillate in the cavity formed between the meniscus and the left end of the duct 16 in FIG. 2. The oscillation will be damped due to the viscosity of the ink. Further, the transducer 28 is energized with a quench pulse which has a polarity opposite to that of the actuation pulse and is timed such that the decaying oscillation will be suppressed further by destructive interference.

The electrodes 34 of the transducer 28 are also connected to an A/D converter 52 which measures a voltage drop across the transducer and also a voltage drop across the resistor 38 and thereby implicitly the current flowing through the transducer. Corresponding digital signals S are forwarded to the controller 48 which can derive the impedance of the transducer 28 from these signals. The measured electric response (current, voltage, impedance, etc.) is signaled to the processor 50 where the electric response is processed further.

Figure 3:
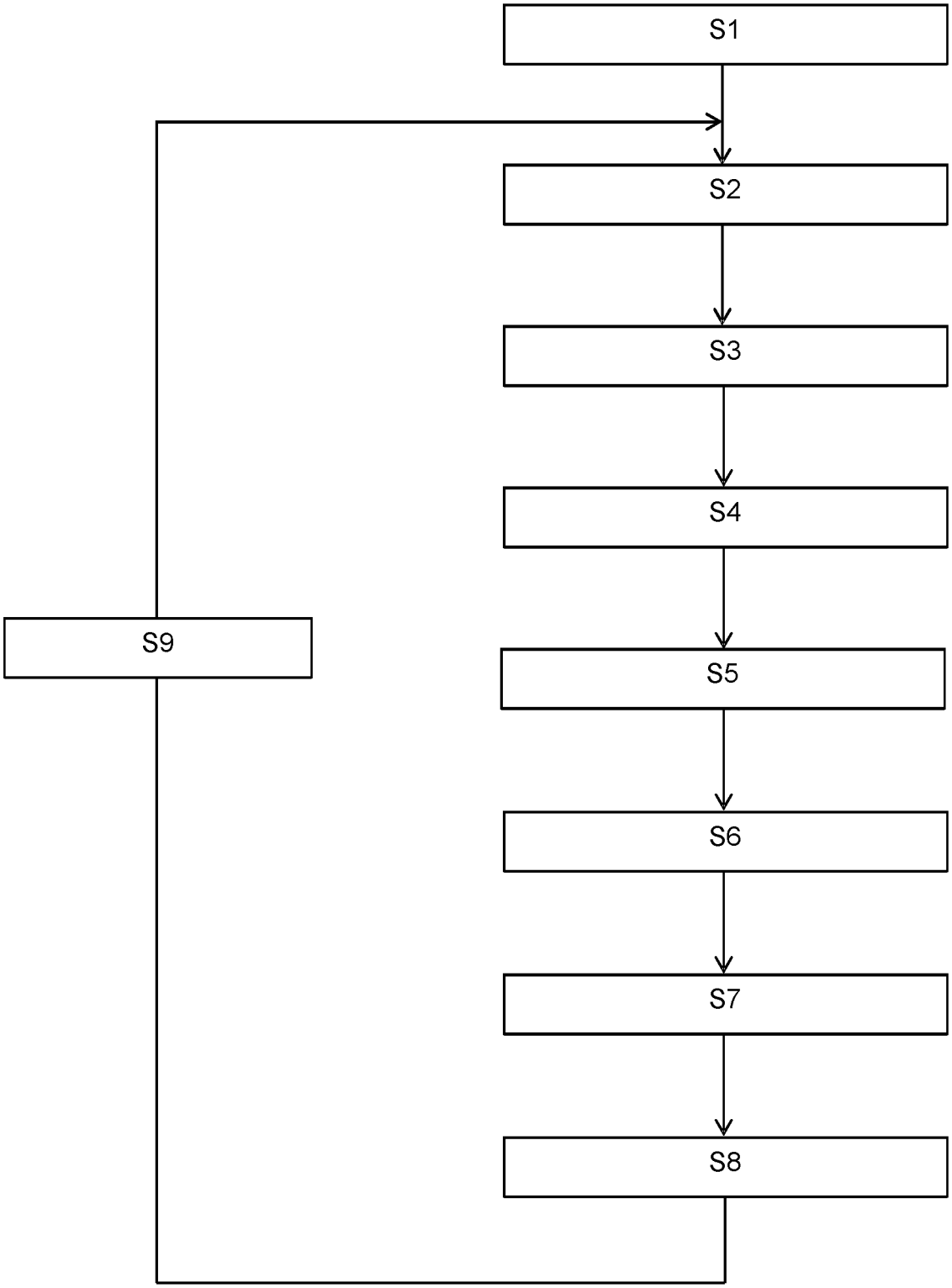
FIG. 3 shows a flowchart of the method of the present invention of determining the operational state of an ejection unit.

A method according to the present invention for detecting an operating state of an ejection unit during the printing of an object is shown in FIG. 3. The method may be executed in any ejection unit, as for example that described in relation to FIG. 2. In the context of the present invention an object shall be understood as comprising any of the many instances in which printing techniques might be used: 2D printing of pages, banners, as well as 2.5D and 3D objects. It also refers to the printing off-line during maintenance actions.

The method starts with an actuation to cause an ejection of liquid onto a recording medium in step S1, and with a determination of the operative state of the ejection unit based on an analysis of the residual pressure wave that the actuation of step generates in the liquid in the ejection unit. In order to reach this determination, step S2 involves sensing the residual pressure wave in the liquid in the duct of the ejection unit, and subsequently performing step S3 in which at least one parameter is generated based upon the residual pressure wave sensed in step S2. Based upon the parameters generated in step S3, a subsequent step S4 is executed, in which it is determined during the printing of every object of the print job, by comparing the at least one parameter generated in step S3 with at least one threshold, whether the ejection unit is in an operative state or in a malfunctioning state.

The process of actuating the transducer in an ejection unit to generate a pressure wave, and subsequently sensing the residual pressure wave is known in the art. It is also known generating one or more parameters from the residual pressure wave sensed, such as amplitude, frequency, damping factor, etc. Said parameters may be determined by analyzing the residual pressure wave in the time domain as well as in the frequency domain. An example can be found in patent applications EP3150380 and PCT/2017/068721 in the name of Oce-Technologies B.V., which are herein incorporated by reference.

Optionally the determination of step S4 further comprises assigning a reliability assessment factor and an ejection failure cause to the determination when it is determined that the ejection unit is in an operative state or in a malfunctioning state. This reliability assessment factor is based on knowledge developed during testing of the ejection units, and assigns a higher factor to those ejection failures which are known to lead Io a smaller number of false positives and negatives. For example, those reliability assessment factors related to problems in the ink duct of the ejection unit, such as presence of air or dust, are assigned a higher reliability assessment factor than those related to shooting angle deviations.

Said reliability assessment factor may be a factor between 0 and 1, wherein a high reliability assessment factor indicates a high likelihood that the assessment performed by the method of the operative state of an ejection unit yields a correct result. As explained above, for several causes of ejection failure such as the presence or air bubbles or dust in the ejection unit, an analysis of the residual pressure waves is capable of identifying the malfunctioning as well as the cause thereof with a high accuracy. As a consequence, such kind of ejection failure will be assigned a reliability assessment factor close to 1. Other causes of ejection failure such as shooting angle deviations lead more often to determinations of a malfunctioning state when the ejection unit is working correctly. As a consequence, the reliability assessment factor assigned is lower, as for example 0.5. The reliability assessment factor may optionally be determined by offline calibration procedures. Additionally, said reliability assessment factor may also be altered using the feedback provided by the present invention after scanning the droplets ejected onto a recording medium, if said scanning process proves that the reliability shown by the determinations is higher than the reliability assessment factor assigned.

The actuation performed in step S1, which is performed such that the generated pressure wave is sufficient to operate the ejection unit, causes the ejection of droplets of liquid onto the recording medium in accordance with print job which is referred to in FIG. 3 as step S5.

In a subsequent stage, step S6 is performed which involves the scanning a location of the recording medium onto which droplets of liquid from the plurality of nozzles have been ejected. This process leads to a scanned image. Said scanning a location of the recording medium is performed every one or more objects of the print job.

Optionally, the method of the present invention further comprises reducing the number of objects of the print job comprising one or more objects for which the scanning a location of the recording medium is performed if both the determinations performed, the one based on analyzing the residual pressure wave and the one by scanning, yield the same result during the printing of one or more consecutive objects of the print job. As an example, if several determinations of the state ejection unit reach contradictory results when using both methods, the method of the present invention performs also both determinations in a subsequent iteration. On the other hand, if the results provided by analyzing the residual pressure wave are consistently confirmed as correct by the scanning process during a plurality of iterations, the method of the present invention gradually reduces the number of iterations in which the scanning process is performed. In this way less processing is needed to improve the results of the determination based on analyzing the residual pressure wave.

Optionally, the assignation of a reliability factor under a threshold when determining the operative state of the ejection unit by analyzing the residual pressure wave triggers the scanning a location of the recording medium onto which droplets of liquid from the plurality of nozzles have been ejected during the execution of the method on the same objects of the assignation. In order to reduce the amount of iterations of the scanning procedure the method of the present invention contemplates not performing said scanning for every object. However, when the determination performed by analyzing the residual pressure wave shows a low reliability (for example, a side shooting nozzle) said scanning is trigger in the same iteration in order to improve the determination.

Next, the scanned image which results from step S6 is analyzed in step S7 in order to make an additional determination of the operative state of the ejection unit.

The method continues with a determination in step S8 of the state of the ejection unit by fusing the information provided by the determinations performed in steps S4 and S7. In this step the determination of step S4 is overridden, and the final determination of the operative state is based on the result of the scanning process, which has a higher reliability.

In the following step S9, the method of the present invention provides feedback about the determined state of the ejection unit to be taken into account when determining the operative state of an ejection unit by analyzing the residual pressure wave during the printing of the subsequent objects of the print job. In the context of the present invention, providing feedback may comprise storing and labelling the determinations performed about the operative state of the ejection unit based both in analyzing the residual pressure wave as well as analyzing the ejections onto a recording medium with an image sensor or scanner. Further, the method of the present invention may comprise storing and labeling the residual pressure wave sensed in the liquid, as well as the at least one parameter generated therefrom. Further, the method of the present invention may comprise storing and labelling the deviations in the ejections from the ejection unit detected by scanning with an image sensor or scanner.

Optionally providing feedback about the determined state of the ejection unit by taking into account both determinations performed comprises storing the at least one parameter generated from the residual pressure wave, and further comprises determining during the printing of a subsequent object of a print job that the ejection unit is in the same state determined during printing by analyzing the scanned image if the difference between the at least one parameter measured during the printing of a second object of the print job and the at least one parameter generated based upon the sensed residual pressure wave is under a threshold. For example, the method of the present invention may be executed, and it reaches a determination that the ejection unit has a shooting angle deviation problem, that is confirmed by a subsequent scanning step. Optionally, the at least one parameter generated may be stored. In subsequent iteration, during the printing of a second object, the generation of a similar parameter may be used to make the same determination. A person skilled in the art would readily understand that if multiple parameters are generated multiple thresholds may be used, and the decisions may be based on one or more of those parameters not being different than the stored ones by more than a threshold difference. Optionally, the method of the present invention does not only store parameters but a complete residual pressure wave. In this case, statistical analysis may be performed between the residual pressure wave stored and the one generated in a subsequent iteration such that based on the statistical parameters inferred a determination may be made about whether the resemblance is high enough to determine the same cause of failure or the correctly functioning of an ejection unit. Also, the present invention may take into account the complete residual pressure wave that was stored and labeled in previous iterations in order to perform a statistical analysis that allows improving the accuracy of subsequent determinations by analyzing the residual pressure wave.

Optionally, providing feedback about the determined state of the ejection unit in by taking into account both previous determinations comprises modifying the thresholds to be used when determining the operative state of the ejection unit during the printing of subsequent objects of a print job. Due to different reasons, as for example aging of the ejection unit or of the liquid to be jetted, sometimes the parameters measured lead to consistent errors in the determinations performed by analyzing the residual pressure wave that can be remedied by altering slightly the thresholds used in the determinations.

Finally, all the above steps are repeated for the next object. In subsequent iterations the data stored and labeled as feedback is used in the determinations performed by analyzing the residual pressure wave in order to improve the accuracy of the determinations. At the same time said determinations performed by analyzing the residual pressure wave, when they are improved with said stored and labeled data, further generate labeled data that is also stored and labeled such that it can be used in subsequent iterations to further improve the result of the determinations.

The invention being thus described, it will be obvious that the same may be varied in many ways. Such variations are not to be regarded as a departure from the scope of the invention, and all such modifications as would be obvious to one skilled in the art are intended to be included within the scope of the following claims.

The invention claimed is:

1. A method for detecting an operating state of an ejection unit during the printing of an object of a print job comprising one or more objects, wherein the ejection unit is arranged to eject droplets of a liquid and comprises a plurality of nozzles, a liquid duct connected to the plurality of nozzles, and an electro-mechanical transducer arranged to create an acoustic pressure wave in the liquid in the liquid duct, the method comprising:

a. actuating the electro-mechanical transducer to generate a pressure wave in the liquid;

b. sensing a residual pressure wave in the liquid;

c. generating at least one parameter based upon the sensed residual pressure wave;

d. determining by comparing the at least one parameter generated in step c. with at least one threshold, whether the ejection unit is in an operative state or in a malfunctioning state;

e. ejecting droplets of liquid from the plurality of nozzles onto the recording medium in accordance with the print job;

f. scanning a location of the recording medium onto which droplets of liquid from the plurality of nozzles have been ejected, thereby providing a scanned image, wherein scanning a location of the recording medium is performed every one or more objects of the print job;

g. analyzing the scanned image of step f. to determine whether the ejection unit is in an operative state or in a malfunctioning state;

h. if the determination of step d. and the determination of step g. determine a different operative state, determining that the ejection unit is the state determined in step g, and providing feedback about the determined state of the ejection unit to be taken into account in step d. during the printing of the subsequent objects of the print job;

i. repeating steps from a. to h. until the last object of the print job.

2. The method according to claim 1, wherein providing feedback about the determined state of the ejection unit in step h. comprises storing the at least one parameter generated in step c., and comprises determining during the printing of a second object of a print job that the ejection unit is in the same state determined during the printing of an object of a print job in step g. if the difference between the at least one parameter measured during the printing of a second object of the print job and the at least one parameter generated in step c. is under a threshold.

3. The method according to claim 1, wherein providing feedback about the determined state of the ejection unit in step h. comprises modifying the thresholds to be used in step d. during the printing of subsequent objects of a print job.

4. The method according to claim 1, further comprising reducing the number of objects of the print job comprising one or more objects for which the scanning a location of the recording medium of step f is performed if the determinations of step d. and of step g. yield the same result during the printing of one or more consecutive objects of the print job.

5. The method according to claim 1, wherein step d. further comprises assigning a reliability assessment factor and an ejection failure cause to the determination when it is determined that the ejection unit is in an operative state or in a malfunctioning state.

6. The method according to claim 5, wherein the assignation of a reliability factor under a threshold in step d. triggers the scanning a location of the recording medium onto which droplets of liquid from the plurality of nozzles have been ejected of step f during the execution of the method on the same objects of the assignation.

7. A droplet ejection device comprising:

a number of ejection units arranged to eject droplets of a liquid, wherein each of the ejection units comprises a nozzle, a liquid duct connected to the nozzle, and an electro-mechanical transducer arranged to create an acoustic pressure wave in the liquid in the duct, and wherein each of the ejection units is associated with a processor configured to perform the method according to claim 1.

8. A printing system comprising the droplet ejection device according to claim 7 as an ink jet print head and a control unit configured to control said processor.

9. A software product comprising program code on a machine-readable non transitory medium, the program code, when loaded into a control unit of the printing system according to claim 8, causes the control unit to control said processor.

10. A software product comprising program code on a machine-readable non transitory medium, the program code, when loaded into a control unit of a printing system according to claim 8, causes the control unit to control said processor.

11. A printing system comprising the droplet ejection device according to claim 7 as an ink jet print head and a control unit configured to control said processor.

* * * * *